United States Patent [19]

Pelc

[11] Patent Number: 4,887,817

[45] Date of Patent: Dec. 19, 1989

[54] METHOD OF MAKING AND PACKAGING GOLF TEES

[76] Inventor: Kenneth L. Pelc, 3823 E. Gulf to Lake Hwy., Inverness, Fla. 32650

[21] Appl. No.: 368,910

[22] Filed: Jun. 16, 1989

Related U.S. Application Data

[63] Continuation of Ser. No. 184,149, Apr. 21, 1988, abandoned.

[51] Int. Cl.[4] ..... A63B 57/00

[52] U.S. Cl. ..... 273/210

[58] Field of Search ..... 273/33, 202, 203, 205, 273/207, 210, 211, 212

[56] References Cited

U.S. PATENT DOCUMENTS

| | | | |
|---|---|---|---|
| 798,952 | 9/1905 | Coast | 273/210 |
| 1,142,997 | 6/1915 | True | 273/33 |
| 1,216,094 | 2/1917 | Duganne | 273/210 |
| 1,335,005 | 3/1920 | Mahony | 273/210 |
| 1,510,705 | 10/1924 | Rolfe | 273/210 |
| 1,604,926 | 10/1926 | MacDonald | 273/210 |
| 1,614,499 | 2/1927 | Stirton | 273/210 |
| 1,897,519 | 2/1933 | Kershaw . | |
| 2,033,269 | 3/1936 | Williams | 273/33 |
| 2,930,615 | 3/1960 | Cowan | 273/33 |

FOREIGN PATENT DOCUMENTS

| | | | |
|---|---|---|---|
| 15101 | 9/1928 | Australia | 273/210 |
| 331058 | 6/1930 | United Kingdom | 273/210 |

OTHER PUBLICATIONS

Information Disclosure by 'Yours Truly, Kenneth L. Pelc', 4 pages—current.

*Primary Examiner*—T. Brown

*Attorney, Agent, or Firm*—Warren L. Franz

[57] ABSTRACT

This golf tee is made from a manufactured, square, cardboard paper box that is wrapped with a lightweight, waterproof, adhesive tape. When not folded flat, this equilateral tee box opens to form a diamond wedge which may be aimed in the desired direction of flight when teeing up. The base perimeter of the wedge, interrupted by a serration on each side, will hug the ground surface while the upper perimeter seats the ball, whose weight bolsters upright stability. One of these fully-opened tees, serving as a retaining band, will bundle into a six-pack, up to five of these different sized, collapsed tees when not in playing use.

4 Claims, 1 Drawing Sheet

METHOD OF MAKING AND PACKAGING GOLF TEES

This application is a continuation of application Ser. No. 184,149, filed 4/21/88, abandoned.

This invention consists of a novel, improved golf tee which I have created from an inch square tubular, cardboard, paper box that is wrapped with an inch wide, clothlike, adhesive tape. The prime object of this invention is to supply a simple, portable golf tee which will serve the golfer efficiently during play.

BACKGROUND OF THE INVENTION

Ever since golf was introduced into this country in the late 1800's, there has been a subverted quest for a better golf tee which will do the job and more. Originally, as we know it, the sand tee was the going thing. However, these proved to be too messy, if not difficult at times; and gave way to the entry of the many different forms of golf tees that have been coming and going up to the present day.

There are wooden tees, styrofoam tees, plastic tees, water soluble tees, tees made out of fertilizer and even molded tees which disintegrate upon clubhead impact. The tee attached to a string so it wouldn't become airborne when tacked to the ground and lost, seemed like a winner. This same principle of restricting flight by using a heavy piece of lead at one end of the string instead of a ground tack has also been tried. Nevertheless, in each instance, the string proved to be too distracting to many players, disrupting their concentration, and thus lost favor.

Unfavorable weather conditions are directly responsible for and do cause other golf tee miseries. Complaints can be readily heard when the hard, dry, sunbaked ground is reluctant to permit penetration of the little plastic peg. Then again, early morning dew and afternoon showers ruin paper tees not properly suited for wet conditions. Many of the rubber, metal and wire tees become airborne with clubhead impact and are lost so easily that their expense sometimes doesn't justify their means. No only do plastic tees shatter easily, especially during use after being exposed to the sun for any length of time; they, like any of the metal tees are notorious for ruining the finish on those new wood golf clubs, giving rise to a real cause for golf tee disenchantment. Like the ant hills and sand mounds, I no longer use them. I have something better.

I noticed that there have been quite a few patents granted to applicants for tees constructed out of paper, some even that unfolded into rectangles or squares that, in my opinion, were never really complete enough to satisfy the all-around wishes of today's golfers. Some are too small, some are too short, while attempts to combine the output of one tee to serve as a high tee or a low tee just by inverting it, just doesn't do the job satisfactorilly. Meanwhile, little has been said about their lack of ruggedness and durability. I know for a fact that after a few plays may are broken and left to litter the tee-off area. This breaking-up and littering is also a very obvious fault of the wooden and plastic tees so profusely used today.

SUMMARY OF THE INVENTION

Here's an excellent time for me to introduce the tee for which I've submitted an application for Letters Patent. This tee will eliminate all the no-no's just mentioned and more. Besides that, it is not really any sophisticated, complex, shop project like some are; but a relatively simple, mathematically and geometrically perfect, down-to-earth piece of golf round equipment.

My invention provides a portable golf support or golf tee formed of one of a plurality of different length sections, severed from a square, tubular, cardboard, paper box. Each golf tee has an upper perimeter providing a ball seat and a lower base perimeter having straight edges interrupted by a plurality of serrations, evenly distributed at least one to a side, thus providing means for excellent ground engaging stability reinforced with the weight of a golf ball. The box is preferably readied in low, medium, and high tubular sections to give corresponding low, medium and high tees. The tees are wrapped with a weatherizing jacket of waterproof, adhesive tape of snow-white color. Each tee can be collapsed flat when not in use and will form a diamond wedge shape for golf shot alignment when used while only partially collapsed. In a preferred packaging arrangement, five collapsed tees are bundled by banding, with one fully opened tee to present a six-pack of tees for easy handling.

As for needless littering, the snow-white jacket of my tee makes it extremely durable and easy to locate, anytime. This tee is also very rugged; not only will it stand up in any kind of weather: it can also absorb beating after beating by your irons or wooden clubs and still be good for more so very few are ever discarded or left to clutter-up a tee-off area. Should it even get a bit dirty from extensive use, it can be washed off and used immediately. Besides that, it floats. What's more, a most unique effect can be utilized when teeing up, if a vertical leading edge or fold of this square diamond wedge tee is aimed in the direction of the desired flight of the ball, the mental awareness of this practice of supplying directional insight can be very rewarding to your golfing psyche.

BRIEF DESCRIPTION OF THE DRAWINGS

To get a better picture of how this embodiment comes to being, here follows a series of drawings which depict the various steps in its development from the store shelf to the bundled, six-pack finish which, incidently, could very well be offered to the public, vending machine style. A descriptive reference to the drawings with a numbers key to the drawings follows first.

NUMBERS KEY TO DRAWINGS

Figure 1:
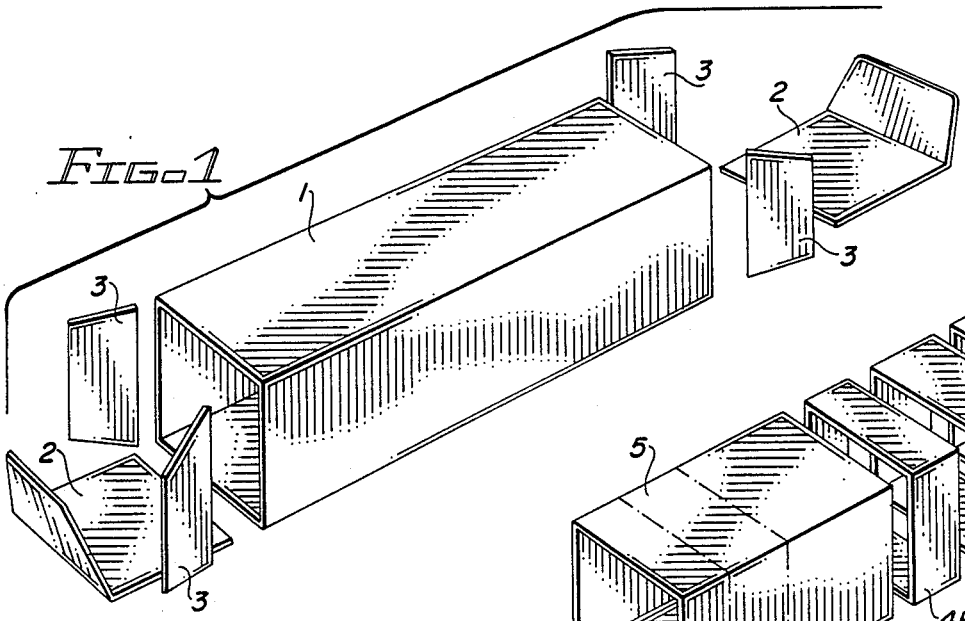
FIG. 1. Perspective of manufactured box with tuck tabs and flaps removed.
Figure 2:
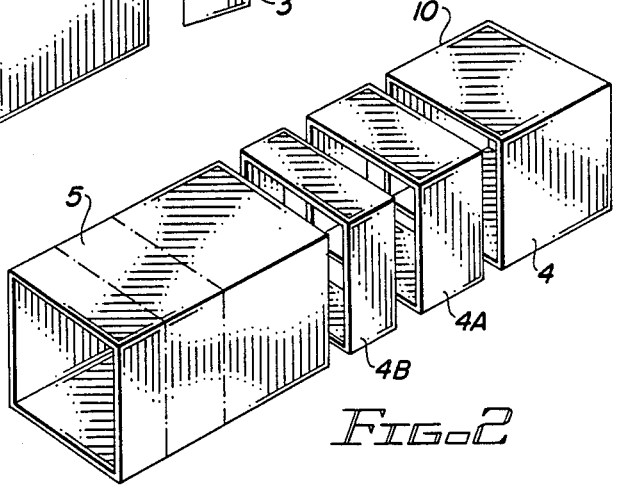
FIG. 2. Trimmed manufactured box is shown in perspective, severed into four sections—three tee boxes and a remainder to be used for more tee boxes.
Figure 4:
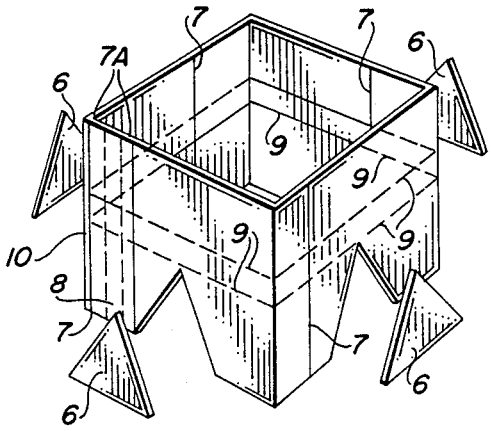
FIG. 4. Perspective of high tee with inverted V-cuts; henceforth, called serations, removed. The overlapping, horizontal tape wrappings are indicated on the inside of the box. The tape wrapping sealer which goes on last covers the gap left by the first and last wrapping which did not come together and overlap. The vertical gap is shown under a sealer.
Figure 3:
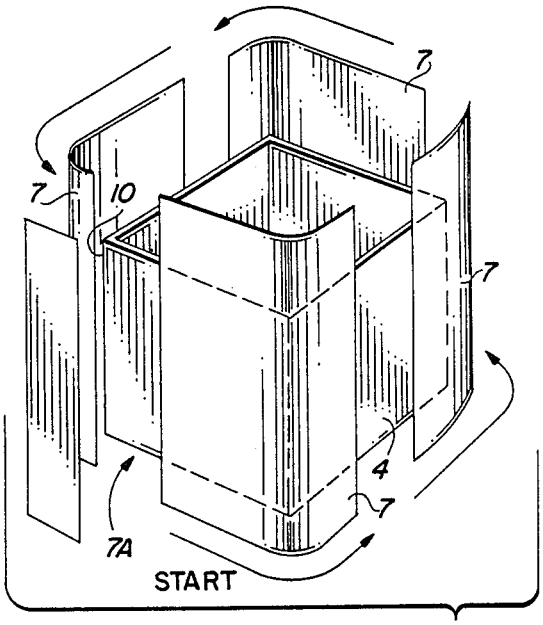
FIG. 3. A perspective of a high tee is shown with tape wrappings in position, ready for counterclockwise application.
Figure 5:
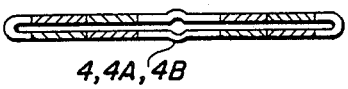
FIG. 5. A collapsed, bottom view of any sized tee is shown with serations indicated.
Figure 6:
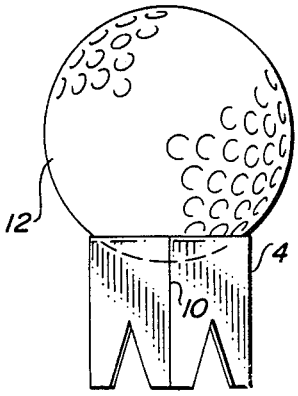
FIG. 6. Frontal view of high diamond wedge tee aimed at the observer along lead foldline with a ball mounted.
Figure 7:
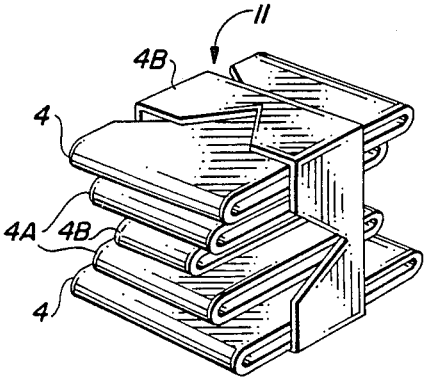
FIG. 7. Perspective view, showing a tee banding a six-pack bundle of assorted tees.

1. Manufactured box.
2. Tuck tabs. (discarded)
3. Tuck flaps (discarded)
4. High tee box. (slightly less than one inch)

4*a*. Medium tee box (slightly more than a half of high tee)

4*b*. Low tee box (slightly more than a half of medium tee)

5. Remainder of #1 available for additional tees.
6. Inverted V-cut serations. (discarded)
7. Four (2' L length × 1') tape wrappings.

7*a*. Abbreviated piece of 2' tape used to seal the gap left between the first #7 and the last #7 wrappings on #4 tee just past lead fold.

8. Gap left on #4 tee, leaving exposed paper, that is sealed by 7*a*.
9. Lateral overlapping sealing lines of the #7 tape wrappings inside #4 tee. Vertical gap, inside and outside of #4 tee, after sealing.
10. The leading edge fold of #4 used to aim tee #4 wedge at the viewer.
11. Six-pack bundle of assorted tees.
12. Teed up golf ball, seated on #4 tee.

DETAILED DESCRIPTION OF PREFERRED EMBODIMENTS

Relating to the drawings, I believe anyone can easily interpret the steps involved in preparing a set of these; tees to use. The drawings, themselves, are pretty much self-explanatory. There are a few points I would like to bring up, however.

As you may have noticed, the low tee (4*b*) and the medium tee (4*a*) are direct copies of #4, the high tee, only differing in height. One must be careful, however, in making the seration on each side of 4*a* and 4*b* so as not to weaken the overall structure. These serations (#6) are shallower, in proportion to said serations on the high tee (#4). The height of the #4 tee is slightly less than one inch because, after the tape wrappings (#7 & 7*a*), the height will increase to almost an inch. The reason for this is the convenience of bundling. The original (#1) tubular box, being a square inch measurement, can best band a set of tees (particularly, #4's of a slightly lesser dimension. As for the wrappings, it is imperative that all the wrappings overlap just a bit; on the inside, laterally and on the outside, vertically. The fact that there is a slight opening after the counterclockwise application of four overlapping #7's, an abbreviated wrapping, 7*a* is applied and seals the gap completely.

Now as for the actual use of the tee, the operation of teeing up is very simple. With a golf ball in the upper part of your fingers and thumb, resting against a tee size of your choice that is held between your thumb and middle finger, teeing up is easy. You should notice here that the natural bit of pressure between your middle finger and thumb will create the diamond tee wedge, and enable you to aim a front fold (#10), in the general direction you would like your shot to go. When this naturally becomes a pre-meditated habit, some golfing good could very well be derived from this extra dimension.

Last of all comes the banding. This can be done with any size tee. There are no specifics here to deal with. In practice, a golfing must is to have available, a bundle of assorted said tees, ready to cope with the shot-making challenge at hand.

Before concluding, it should be emphasized that this tee has been created for today's golfer. It is not only simple and economical in construction, its weatherproofing makes it very durable. Combined with its ruggedness which resists breaking up, you have a golf tee that will last and last. No matter what the original labeling was on the box, be it sparkplug or toothache outfit, the tape jacket seals in all; and you have a beautiful, clean, snow what golf tee. They don't injure finishes on wood golf clubs and can't be blamed for dulling mower blades, should any such general objects be heard from the club maintenance shed. Any given tee will continue to supply you with the same height always.

Besides bundling for a counter grab basket or a vending machine, your wallet will, very nicely hold a few extras should you come up short sometime and need one. Inverting a tee to avoid serations and piggy-backing it on another is in no way out of the question should more height be desired in an unusual situation. As for aiming the tee, the square diamond wedge will set up readily so the golfer can take advantage of this mental process dimension, naturally without any fuss. For carrying an ad or announcement, any or all of the four sides offer ample space on any given tee to convey just such a message. While new improvements in golf equipment are 'Out of this World' these days, this golf tee should in no way be considered too old, outmoded, or 'out of date'. It's what the game really needs to help put it on good footing, furnishing the link with golf's, 'Royal and Ancient' past. After all. a diamond is forever. Use these tees for better golf.

In closing, I would like to mention the fact that there are numerous variations possible in the future of said tee which, no doubt, cannot be overlooked. Even before going any further, there is one point which should be made clear right now. The use of any rectangular box for tee construction is out because it upsets the true embodiment of this invention which includes tee aiming. Meticulous golfers may employ this dimension by aiming for a particular spot on the fairway, just like meticulous golfers aim for the pin, at times, not just the green area. As for new golfers employing this dimension and getting something out of it; one has to be open-minded. Let's face it, the main thing a beginner is concerned with is having the ball elevated off the ground so he can hit it. So, no matter how said tee is set up, it will still do the job as it was supposed to do, and that is; support the ball at a specified elevation above ground so it can be easily hit. Anything else comes with experience and that takes time.

Tee size is another flexible matter which, in its own scope can assume quite a few different states of the art. There are some players who use a deep-faced driver off the tee. This usualy calls for a tee with more elevation than a #4 tee. Presto, this is no trick so you go ahead and make one that is suitably adaptable in height to your specific needs. Tee size need not only vary with height; the perimeter of box #1 could vary either way, bigger or smaller also.

Care should be exercised in choosing a different sized square, tubular box. Although there aren't any set rules or regulations concerning a selection; there are, nevertheless, a few needless, undesirable conditions to avoid. A box whose perimeter is too big may appear too dominant when teeing up and prove to be too distracting. A box, too small in perimeter size, can be a real nuisance when teeing up, due to its lack of stability. After all, a ball is approximately only one and three-fifths of an inch in diameter. Common sense pretty much limits the extent of any size variations. When this is in doubt, trial and error will always work. Don't forget, this is an economical project; and you are at no great risk to try. Duplicating similar prototypes is by no means 'out of the question'; and as long as 'yours truly' is protected to a certain extent in the process, I am all for it.

Last, but not least, I look forward to the future to seeing a new super material that can be used which will possess all the good basic qualities of my invention. On second though, I don't doubt that the future is now, and there is a material, in existence, just waiting for a call. I also see an economical, one piece construction square tee that is produced in all colors except black or green for security reasons. Something like this on the market could very well take hold and help to make playing golf all kinds of fun for everybody.

Having completed a resume of my invention, what I claim and desire to secure by Letters Patent is as follows:

I claim:

1. A method of making a multiple pack bundle of at least three golf ball tees of different heights from a square, tubular, cardboard, paper box which has tuck tabs and end flaps, comprising the steps of:

removing the tuck tabs and end flaps from the box;

severing at least three different length sections from the box after removal of the tabs and flaps, each section forming a tee having four fold-joined sides with upper straight edges that define an upper perimeter ball seat and with lower straight edges that define a lower perimeter base;

cutting V-cut serrations, evenly distributed one to a side, to partly interrupt the lower straight edges of each said tee;

collapsing at least two of said serrated tees flat about said fold-joints; and bonding said collapsed tees with one fully opened tee to provide the multiple tee pack bundle.

2. A method as in claim 1, further comprising the step of wrapping each said tee with a weatherizing jacket of waterproof, adhesive tape for making said tee moisture-proof and durable.

3. A method as in claim 2, wherein said wrapping step occurs between the severing and cutting steps.

4. A method as in claim 2, wherein said wrapping step comprises wrapping said tee with a plurality of strips each having opposite longitudinal edges and opposite lateral edges, the longitudinal edges of adjacent strips overlapping along lines parallel to and spaced from said fold-lines, and the lateral edges of the same strip overlapping on an inside surface of said tee along lines perpendicular to said fold-lines located intermediate said upper and lower straight edges.

* * * * *

UNITED STATES PATENT AND TRADEMARK OFFICE

CERTIFICATE OF CORRECTION

PATENT NO. : 4,887,817

DATED : December 19, 1989

INVENTOR(S) : Kenneth L. Pelc

It is certified that error appears in the above-identified patent and that said Letters Patent is hereby corrected as shown below:

Column 1, line 43-change "No" to --Not--
line 60-change "may" to --many--.

Column 4, line 12-change "snow what" to --snow white--;
line 14-change "objects" to --objections--;
line 57-change "usualy" to --usually--.

Column 5, line 14-change "though" to --thought--.

Signed and Sealed this

Fifteenth Day of January, 1991

*Attest:*

HARRY F. MANBECK, JR.

*Attesting Officer*

*Commissioner of Patents and Trademarks*